US005669720A

United States Patent [19]

Negishi et al.

[11] Patent Number: 5,669,720

[45] Date of Patent: Sep. 23, 1997

[54] THERMAL PRINTER WITH MINIMIZED POWER DIFFERENCE BETWEEN SEQUENTIALLY DRIVEN BLOCKS OF PRINTING ELEMENTS

[75] Inventors: Kiyoshi Negishi; Katsumi Kawamura; Katsuyoshi Suzuki; Hiroshi Orita; Minoru Suzuki, all of Tokyo, Japan

[73] Assignee: Asahi Kogaku Kogyo Kabushiki Kaisha, Tokyo, Japan

[21] Appl. No.: 606,548

[22] Filed: Feb. 26, 1996

Related U.S. Application Data

[63] Continuation of Ser. No. 332,150, Oct. 31, 1994, abandoned.

[30] Foreign Application Priority Data

| | | | |
|---|---|---|---|
| Oct. 30, 1993 | [JP] | Japan | 5-294464 |
| Oct. 30, 1993 | [JP] | Japan | 5-294465 |
| Nov. 11, 1993 | [JP] | Japan | 5-305862 |
| Nov. 11, 1993 | [JP] | Japan | 5-305863 |

[51] Int. Cl.[6] ..... B41J 2/355

[52] U.S. Cl. ..... 400/120.05; 400/120.06; 400/120.12; 400/120.1; 347/180

[58] Field of Search ..... 400/120.01, 120.05, 400/120.06, 120.12, 120.15, 120.1; 347/181, 182, 180

[56] References Cited

U.S. PATENT DOCUMENTS

| | | | |
|---|---|---|---|
| 4,738,553 | 4/1988 | Uemura et al. | 400/618 |
| 4,857,959 | 8/1989 | Shimbo et al. | 355/276 |
| 5,072,237 | 12/1991 | Takaoka | 347/181 |
| 5,412,405 | 5/1995 | Nureki | 347/182 |

FOREIGN PATENT DOCUMENTS

| | | | |
|---|---|---|---|
| 176161 | 7/1988 | Japan | 400/120.1 |
| 112027 | 5/1993 | Japan | 400/120.12 |

*Primary Examiner*—Edgar S. Burr
*Assistant Examiner*—Steven S. Kelley
*Attorney, Agent, or Firm*—Greenblum & Bernstein P.L.C.

[57] ABSTRACT

A thermal printer has a thermal head provided with a plurality of thermal elements arranged linearly. The thermal printer also includes a power source capable of supplying a predetermined power level to the plurality of thermal elements which generate heat, a drive for driving the thermal elements with power, and a controller for dividing the plurality of thermal elements into at least two groups. The grouping of the thermal elements is determined such that a difference in power consumption between the groups is minimized.

8 Claims, 18 Drawing Sheets

| FIG. 7A | FIG. 7B |
|---|---|

a
b
SHEET DETECTED ?
S325
N
Y
POSITION SHEET AT PRINTING POSITION
S327
TRANSMIT DATA TO THERMAL HEAD
S329
START MOTOR
S331
PRINTING
S401
VOLTAGE >13V
S403
N
Y
OUTPUT 2 /STB SIGNALS SIMULTANEOUSLY
S405
OUTPUT 4 /STB SIGNALS SEQUENTIALLY
S407
VOLTAGE >12V
S409
Y
N
DISPLAY WARNING INDICATOR
S411
VOLTAGE > MINIMUM OPERABLE VOLTAGE
S413
Y
N
STOP
PRINTING FINISHED ?
S415
N
Y
DISCHARGE SHEET
S417

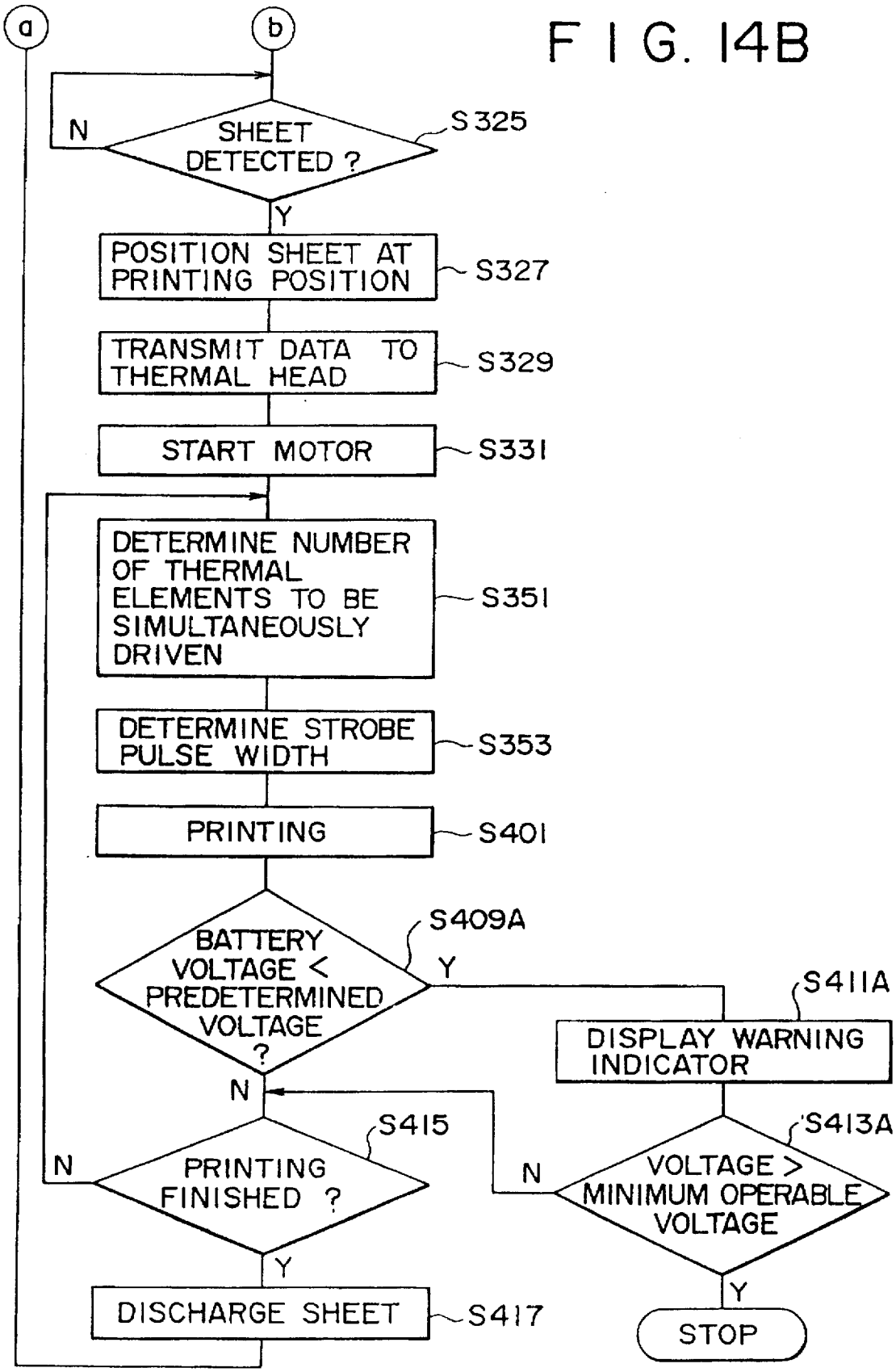
FIG. 14B
a
b
SHEET DETECTED ?
S325
N
Y
POSITION SHEET AT PRINTING POSITION
S327
TRANSMIT DATA TO THERMAL HEAD
S329
START MOTOR
S331
DETERMINE NUMBER OF THERMAL ELEMENTS TO BE SIMULTANEOUSLY DRIVEN
S351
DETERMINE STROBE PULSE WIDTH
S353
PRINTING
S401
BATTERY VOLTAGE < PREDETERMINED VOLTAGE ?
S409A
Y
N
DISPLAY WARNING INDICATOR
S411A
PRINTING FINISHED ?
S415
N
Y
VOLTAGE > MINIMUM OPERABLE VOLTAGE
S413A
N
Y
DISCHARGE SHEET
S417
STOP

THERMAL PRINTER WITH MINIMIZED POWER DIFFERENCE BETWEEN SEQUENTIALLY DRIVEN BLOCKS OF PRINTING ELEMENTS

This application is a continuation of application Ser. No. 08/332,150, filed Oct. 31, 1994, now abandoned.

BACKGROUND OF THE INVENTION

The present invention relates to a thermal printer which prints a letter or character image on a thermosensitive sheet.

Conventionally, a thermal printer prints alphanumerical characters on a thermosensitive sheet by using a thermal head having a plurality of thermal elements to apply energy to the thermosensitive sheet. The thermosensitive layer on the thermosensitive sheet is heated and developed (colored) when a certain heat energy is applied. The darkness of the color depends on the quantity of the applied energy. More specifically, the darkness of the color is related to the density of the thermosensitive pigment in the thermosensitive layer, that undergoes a change in color when heat is applied to the thermosensitive paper. However, in such a printer, if the energy generated by the thermal elements fluctuates during a printing operation, the darkness of the print will not be uniform, and a poor quality printout will result.

Further, in the thermal printer, if a battery such as a nickel-cadmium battery is used for driving the thermal elements, and if the number of the elements to be driven simultaneously is relatively large, current flowing through each element may be less than the required amount, and the printed characters may be too light, making them unreadable.

If power available from the Nickel-Cadmium battery becomes low, it is not possible to simultaneously drive even a moderate number of thermal elements as the current flowing through each element may be less than the required current. In this case, the characters printed by the printer will also be too light, making them unreadable.

Still further, in the thermal printer using a battery such as a nickel-cadmium battery for driving the thermal elements, if a print ratio is high (i.e., the number of the elements driven simultaneously is relatively large), the temperature of the thermal head will increase, resulting in the temperature of the thermal elements being higher than expected. This results in darker or fuzzy characters being formed, which may be unreadable. However, if a print ratio is low (i.e., the number of the elements driven simultaneously is relatively small), the temperature of the thermal head will decrease, resulting in the temperature of the thermal elements being lower than expected. This results in lighter characters being printed, which may be unreadable.

If a line that is printed by the thermal printer having a plurality of thermal elements, has a high print ratio, the temperature of the print head will increase, as mentioned above. However, if a subsequent line to be printed has a low print ratio, the temperature of the print head may be higher than expected, as a result of the residual heat on the print head after printing the line having a high print ratio. Therefore, the subsequently printed line may be printed darker than required, producing an unwanted character image.

Conversely, if a line having a low print ratio is printed, then a line having a high print ratio is to be printed as a subsequent line, the thermal print head may have a temperature that is lower than expected when the subsequent line is to be printed. Therefore, the printed characters may be too light, making them unreadable.

SUMMARY OF THE INVENTION

Therefore it is an object of the present invention to provide a thermal printer which can provide an adequate power supply to the thermal elements, even if a large number of thermal elements are to be driven simultaneously.

It is also an object of the present invention to provide a thermal printer which can provide an adequate power supply to the thermal elements, even if the available energy in the battery is low.

It is a further object of the present invention to provide a thermal printer which enables a constant darkness of the developed character image, regardless of the number of elements that are simultaneously driven.

It is a further object of the present invention to provide a thermal printer which enables a constant darkness of the developed character image on-line regardless of the print ratio of the previous line.

According to one aspect of the present invention, there is provided a thermal printer having a thermal head provided with a plurality of thermal elements arranged linearly. The printer includes:

- a power source capable of supplying a predetermined power level to the plurality of thermal elements;
- a driver for driving the thermal elements with the power, the thermal elements generating heat; and
- a controller for dividing the plurality of thermal elements into at least two groups.

The groups of thermal elements are determined such that a difference in power consumption between the two groups is minimized.

According to another aspect of the present invention, there is provided a thermal printer having a thermal head provided with a plurality of thermal elements. The thermal printer includes:

- a battery for supplying power to the plurality of thermal elements;
- a controller for detecting an operating voltage of the battery, which determines a remaining life of the battery in accordance with the detected voltage; and
- a driver capable of simultaneously driving the plurality of thermal elements.

The controller determines a maximum number of thermal elements which can be simultaneously driven based on the remaining life of the battery, and for controls the driver to drive the plurality of thermal elements such that the number of simultaneously driven thermal elements is less than the maximum number.

According to a third aspect of the present invention, there is provided a thermal printer having a thermal head provided with a plurality of thermal elements used for printing data on a sheet. The thermal printer includes:

- a driver for driving the plurality of thermal elements simultaneously;
- a controller for determining the number of thermal elements to be driven simultaneously in accordance with the data, and to control the driver to vary an amount of heat generated by each of the thermal elements in accordance with the number of thermal elements to be driven.

According to a fourth aspect of the present invention, there is provided a method of driving a plurality of thermal elements on a thermal head of a thermal printer, which are arranged linearly. The method includes the steps of:

- dividing the plurality of thermal elements into a plurality of blocks, each of the blocks having a similar number of thermal elements;

combining the plurality of the blocks into at least two groups such that a difference in a number of the thermal elements to be simultaneously driven in each group is minimized; and driving the groups at different time intervals.

According to a fifth aspect of the present invention, there is provided a method of driving a plurality of thermal elements on a thermal head of a thermal printer supplied with power from a battery, with the thermal elements being arranged linearly. The method includes the steps of:

detecting an operating voltage of the battery;

determining a remaining life of the battery in accordance with the detected voltage;

determining a maximum number of thermal elements which can be simultaneously driven based on the remaining life of the battery;

dividing the thermal elements into a number of predetermined blocks, each of the blocks having a number of thermal elements which is less than the maximum number; and driving each of the blocks of thermal elements during different time intervals.

DESCRIPTION OF THE ACCOMPANYING DRAWINGS

FIGS. 14, 14A and 14B are a flowchart illustrating a fifth embodiment of the invention.

DESCRIPTION OF THE EMBODIMENTS

Figure 1:
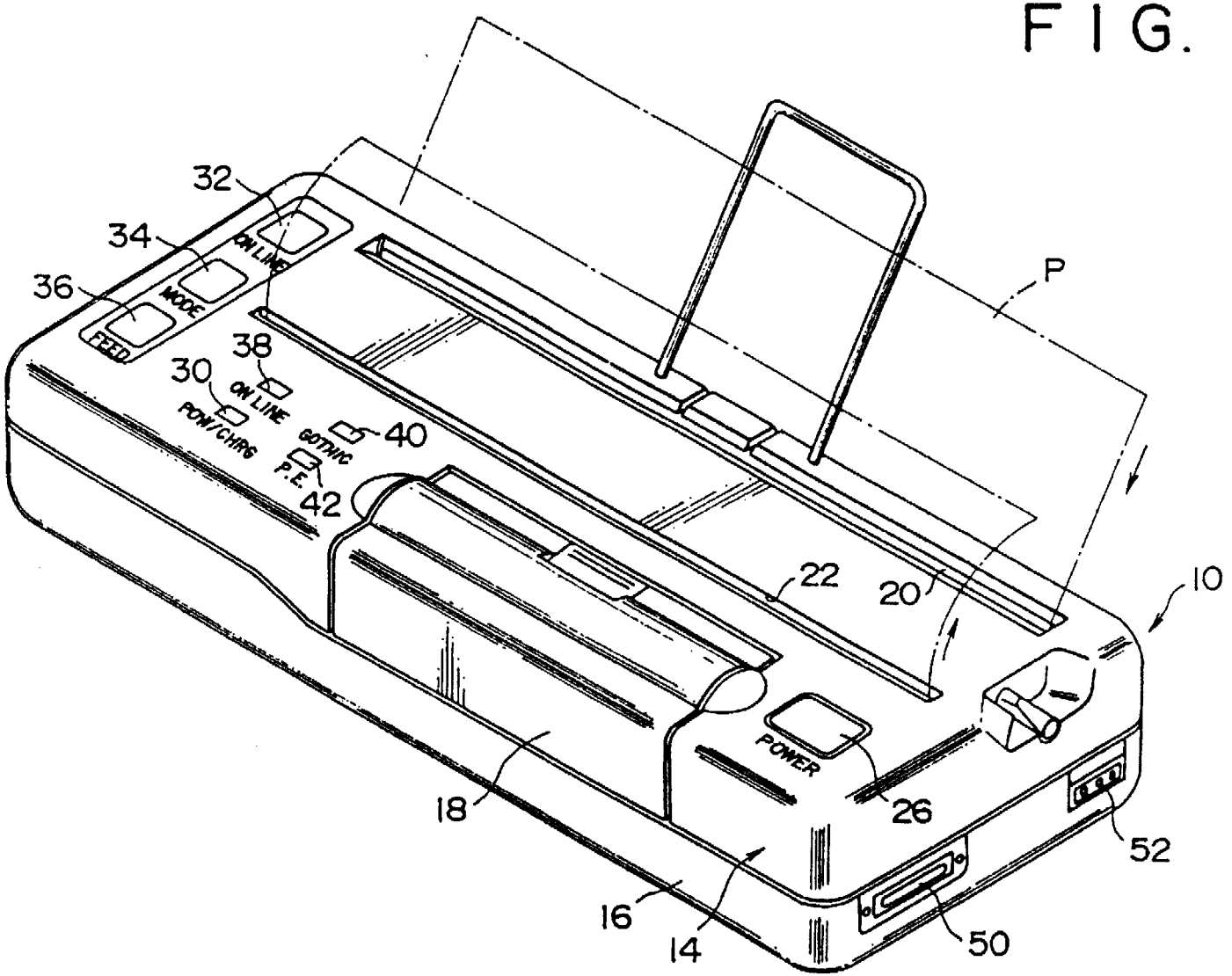
FIG. 1 is a perspective view of a thermal printer to which the invention is applied.

FIG. 1 is a perspective view of a thermal line printer 10 to which the present invention is applied.

As shown in FIG. 1, the thermal line printer 10 has an upper cover 14 and a lower housing 16 which are detachably coupled to each other. A battery cover 18 is provided on the upper cover 14 for covering a battery chamber where an internal nickel-cadmium battery 64 is mounted. On the upper surface of the upper cover 14, a sheet inlet opening 20 is formed. In this embodiment, an A5 size sheet P is inserted through the inlet opening 20. At the central portion of the upper cover 14, a sheet discharge opening 22 is defined.

A power switch 26 is provided on the right-hand side of the upper cover 14 (as shown in FIG. 1). By pressing the power switch 26, the printer 10 is toggled ON or OFF. When the thermal line printer 10 is on, a power indicator 30 is lit. The power indicator 30 blinks when the available power from the internal battery 64 becomes low.

There are three buttons provided on the left-hand side area of the upper surface of the upper cover 14 (as shown in FIG. 1). These are an on-line button 32, a mode selection button 34 and a feed button 36.

The printer is toggled on-line or off-line by pressing the on-line button 32. When the printer is on-line, an on-line indicator 38 provided on the upper surface of the upper cover 14 is lit.

Pressing the mode selection button 34 toggles the font to be used for printing between "Gothic" and "Minchou" fonts. A font indicator 40 is provided on the upper surface of the upper cover 14. When the Gothic font is selected, the font indicator 40 is lit, and when the Minchou font is selected, the font indicator 40 is not lit.

While the feed button 36 is pressed down, a sheet feed mechanism (not shown) is driven and the sheet P having been loaded in the thermal line printer 10 is fed and discharged. A paper out indicator 42 is provided on the upper cover 14, to indicate that there are no sheets loaded in the printer 10. The indicators 30, 48, 40 and 42 are LEDs (Light Emitting Diodes) in the present embodiment.

A communication connector 50 and a DC connector 52 are provided on the right-hand side surface of the lower housing 16. A printer cable is plugged into the communication connector 50 to connect the printer 10 with a host computer (not shown). Data to be printed is transmitted through the communication connector 50.

The DC connector 52 is a connector to which DC voltage is applied from an external device such as an AC to DC converter (hereinafter referred to as an AC adapter), when the external DC voltage source is used instead of the internal battery 64.

Figure 2:
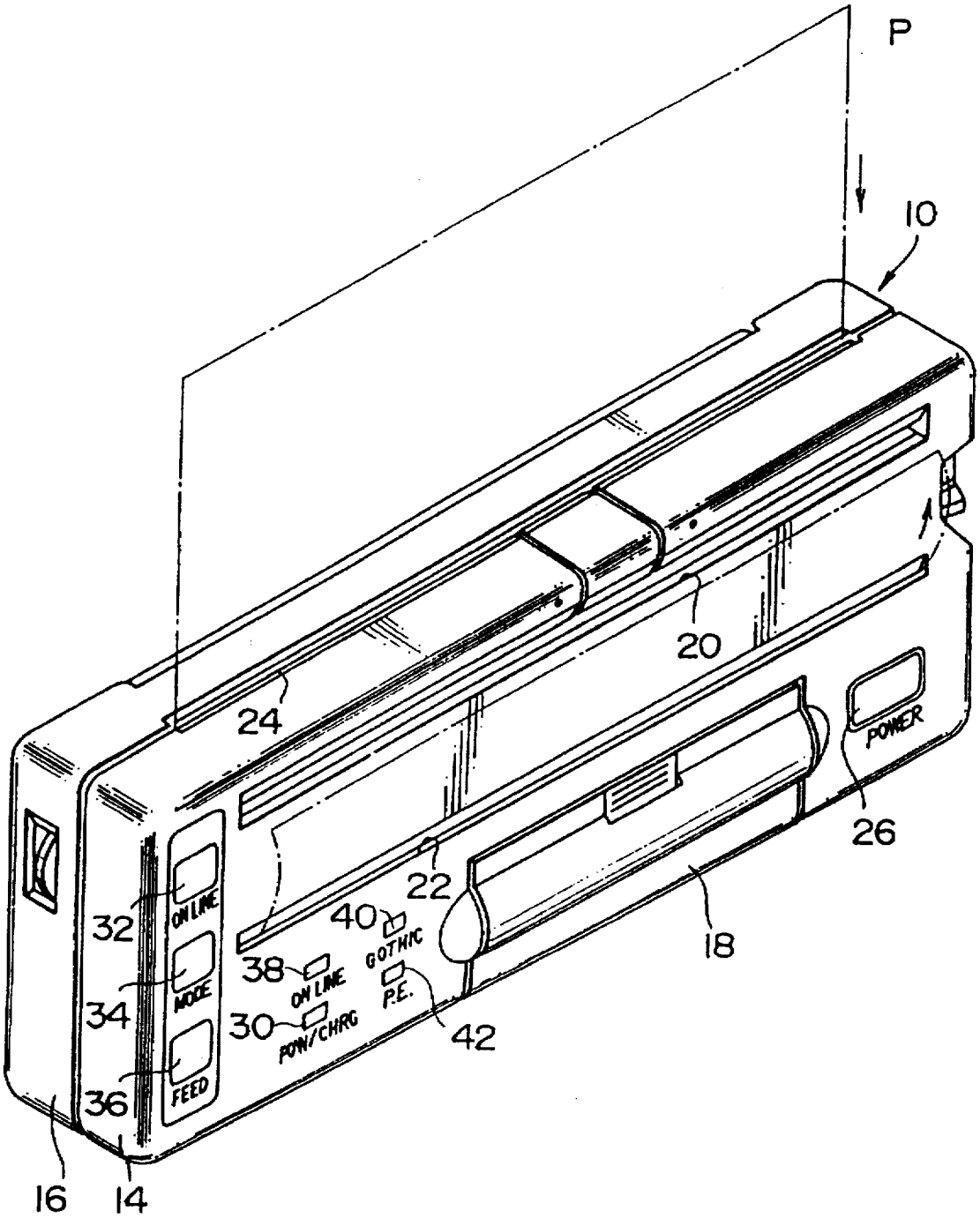
FIG. 2 is another perspective view of the thermal printer.

FIG. 2 is another perspective view of the thermal printer 10. As shown in FIG. 2, the thermal printer 10 has another sheet inlet opening 24. The sheet P can be inserted in the printer 10 either through the opening 20 or through the opening 24. In either case, the sheet P is discharged from the discharge opening 22.

Figure 3:
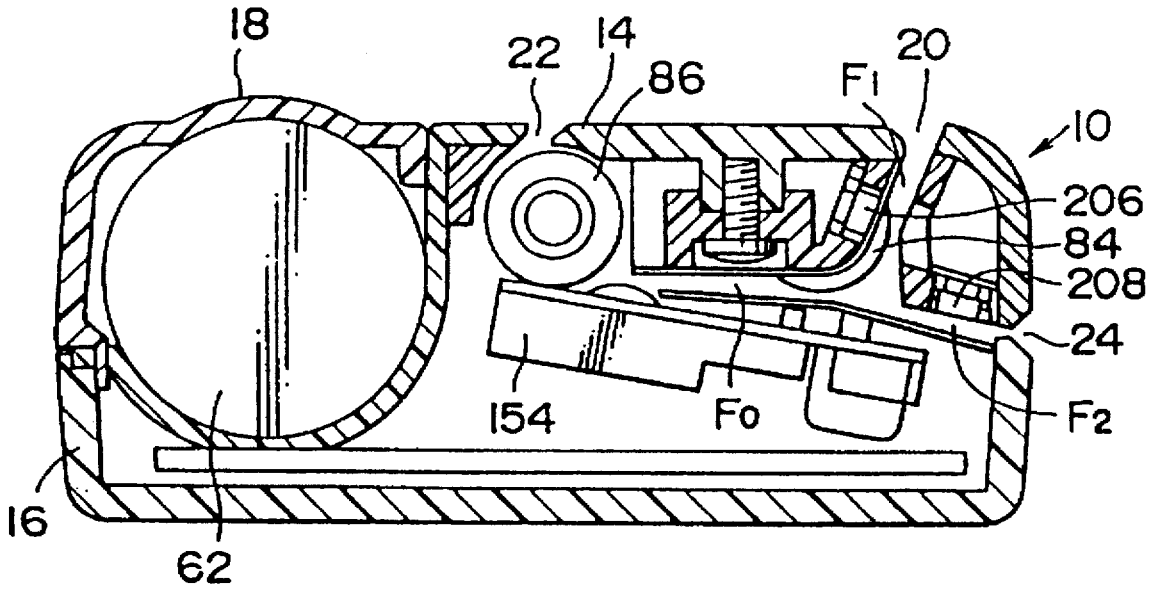
FIG. 3 is a cross-sectional view of the thermal printer.

FIG. 3 is a cross-sectional view of the thermal printer 10. Inside the upper cover 14 and lower housing 16, a battery chamber 62 for accommodating the nickel-cadmium battery is formed. A platen roller 86 is rotatably supported by a frame member (not shown) at the right of the battery chamber 62 (as shown in FIG. 3). The platen roller 86 extends along a longitudinal direction (right and left direction in FIG. 1). A thermal head 154 is provided with a plurality of thermal elements arranged in line along the longitudinal direction. The thermal head 154 is biased towards the platen roller 86 so that the thermal elements forcibly contact the circumferential surface of the platen roller 86. The thermosensitive sheet P is introduced from the inlet opening 20 or 24, fed along a feed path F1 or F2, and then fed along a common feed path F0 by means of a feed roller 84. An image of a character is printed line by line at a printing position where the thermal elements face the platen roller 86 by the linearly arranged thermal elements on the thermal head 154, while the sheet P is being fed by the platen roller 86. The sheet P is then fed by the platen roller 86 to be discharged out of the printer 10 through the discharge opening 22.

Figure 4:
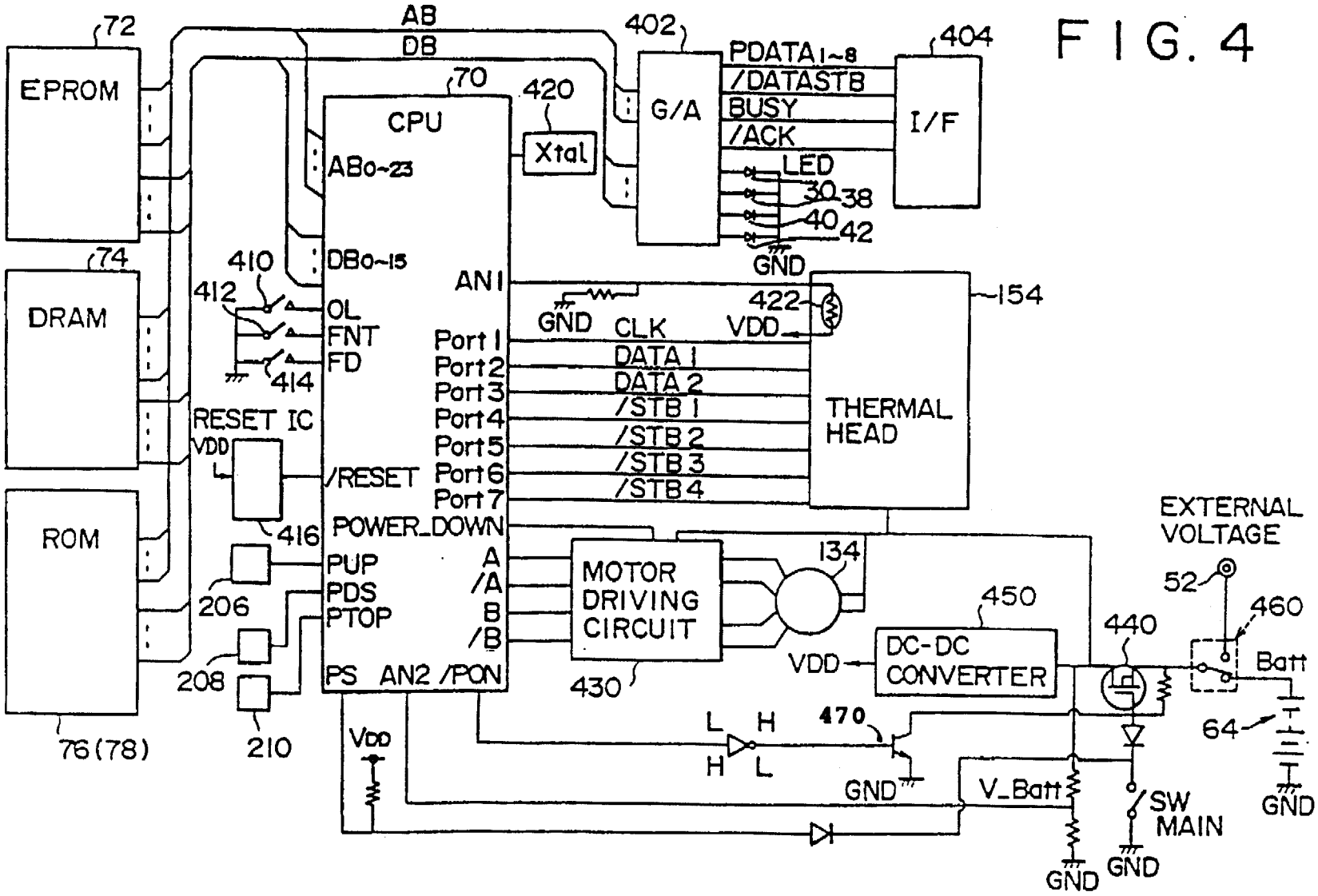
FIG. 4 is a block diagram illustrating a control system of the thermal printer.

FIG. 4 is a block diagram of a control system of the thermal line printer 10.

A microprocessor 70 is connected with an EPROM 72, DRAM 74, first font ROM 76, second font ROM 78, and gate array 402 through address ports AB0–AB23 and data ports DB0–DB15. The microprocessor 70 outputs address data to an address bus AB by way of the address ports AB0–AB23, and exchanges data through a data bus DB by way of the data ports DB0–DB15.

The EPROM 72 stores a program for controlling the performance of the printer 10, and initializing the operation of the printer 10. The DRAM 74 has an area where a bit map is developed, an area for storing data transmitted through an interface 404, and some other work areas. The printer 10 uses two types of fonts, "Gothic" and "Minchou", and font data thereof are stored in the ROM 76 and the ROM 78, respectively (only one ROM is shown in the drawing).

The microprocessor 70 uses the gate array 402 to exchange data through the interface 404, and drive the indicators 30, 38, 40, and 42.

The interface 404 is a printer interface and has eight data lines PDATA 1 through 8 and three control lines /DATASTB, BUSY, and /ACK. The line /DATASTB initiates the inputting of data to the printer 10, the line BUSY indicates that the printer 10 cannot accept the print data, and the line /ACK acknowledges reception of the print data. In the specification, a low active signal, and lines and ports which exchange the low active signal are denoted with a mark "/" placed before the name of the signal or port.

The microprocessor 70 has three ports OL, FNT, and FD which monitor the state of switches 410, 412, and 414, respectively. The switch 410 is toggled ON or OFF with the operation of the on-line button 32. If the switch 410 is OFF, the printer 10 cannot receive the print data from the host computer. The switch 412 is toggled ON or OFF with the operation of the mode select button 34, in order to switch the font type to be used in printing operation. The switch 414 is ON when the feed button 46 is held pressed down to feed the sheet P. The microprocessor 70 obtains the states of the switches 410, 412, and 414, and controls the operation of the printer 10 accordingly.

A divided voltage V_Batt of the internal battery 64 (or an external DC voltage) is applied to an analog port AN2. The microprocessor 70 A/D converts the applied analog voltage to a digital value, and detects the voltage of the battery 64 (or the external voltage source). A reset IC 416 is provided for directly detecting the voltage of the output of the DC—DC converter 450. If the detected voltage is less than a predetermined voltage value, the reset IC 416 outputs a reset signal to a /RESET port of the microprocessor 70. For example, if the output of the DC—DC converter 450 becomes lower than the predetermined voltage value during the operation, or if the output of the DC—DC converter 450 does not exceed the predetermined voltage value when the printer 10 is turned ON, the microprocessor 70 is reset.

First and second sensors 206 and 208 are provided in the sheet feed paths F1 and F2, respectively, and detect the presence of a thermosensitive sheet P and output a sheet detection signal. A third sensor 210 which is provided on an upstream side of the thermal head 154 in the common path F0 also detects the presence of the sheet P and outputs a sheet detection signal. The output signals from the sensors 206, 208 and 210 are input to ports PUP, PDS, and PTOP, respectively, of the microprocessor 70. The microprocessor 70 detects the position of the sheet P inside the printer 10 by monitoring the input sheet detection signals.

A reference clock signal is generated by a crystal 420 and transmitted to the microprocessor 70. In accordance with the reference clock signal, the microprocessor 70 outputs a transfer clock CLK from a port Port1. Synchronously with the transfer clock CLK, print data bit-mapped in the DRAM 74 is transferred line by line to the thermal line head 154. The print data for one line is divided into two blocks of data DATA1 and DATA2, and transmitted from ports Port2 and Port3.

Energy (heat) radiated from each thermal element is controlled with strobe signals /STB1–/STB4 which are outputted from ports Port4 through Port7. Thus, DATA1 and DATA2 identify the thermal elements to be driven, and strobe signals /STB1–/STB4 drive the identified thermal elements to radiate the desired heat.

A thermistor 422 is provided on the thermal head 154 for detecting the temperature of the thermal head 154. The output of the thermistor 422 is input to a port AN1. The microprocessor 70 A/D converts the signal input to the port AN1, and detects the temperature of the thermal line head 154.

Signals for controlling the performance of a motor 134 are transmitted through ports A, /A, B, /B, and POWER_DOWN to a motor drive circuit 430.

A port /PON outputs a signal for turning ON or OFF a FET 440. Initially, when the power switch is depressed, current flows through the Gate-Source resistor, the FET 440 is turned ON, and voltage (14.4 V) of the battery 64 is applied to the DC—DC converter 450. The DC—DC converter 450 outputs voltage used for driving the thermal head 154, the motor drive circuit 430, and other circuits. The DC—DC converter 450 also outputs a drive voltage VDD (5 V) to drive the microprocessor 70, EPROM 72, DRAM 74, ROM 76, and ROM 78. When the circuit is operating the microprocessor 70 ties port /PON Low. Once the FET 440 is turned ON by depressing the main switch, the FET 440 is kept ON after the power switch is released. Thus, if the main switch is momentarily depressed when the printer is OFF, the FET 440 is turned ON and the status will be maintained until the main switch is depressed again.

When the main switch is again depressed, the microprocessor 70 detects that the port PS is tied Low momentarily, and makes /PON High. Transistor 470 is then turned OFF and the Gate is floating. Then, the FET 440 is turned OFF.

The thermal line printer 10 receives power from the internal nickel-cadmium battery 64, which outputs 14.4 VDC. Further, the printer 10 has the DC connector 52 to which an external voltage source such as an AC adapter for converting 100–120 VAC to 14.4 VDC can be connected. When the AC adapter is connected, a switch 460 is switched such that the internal battery 64 is disconnected from the control system, and the AC adapter is connected to the control system.

Figure 5:
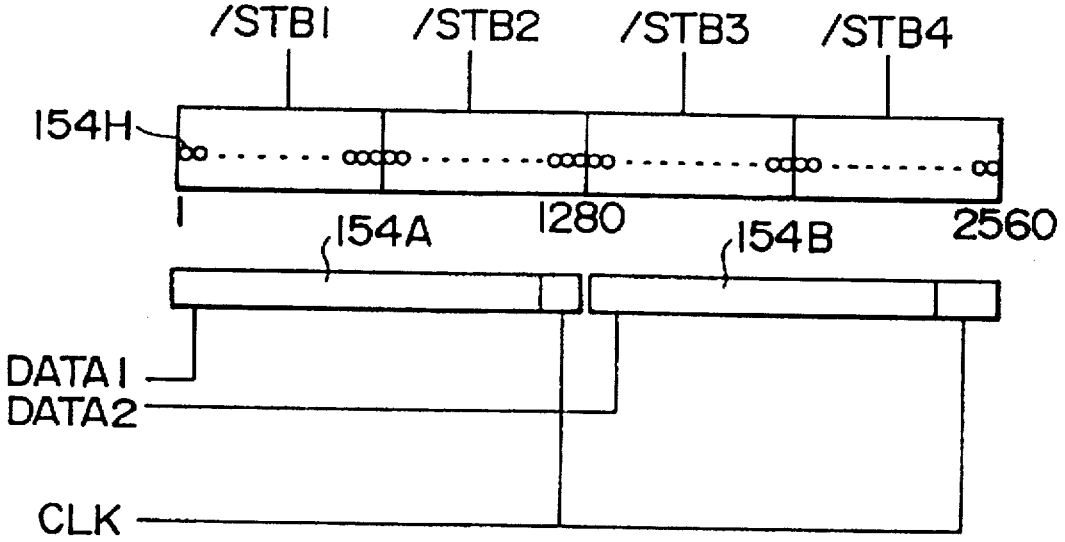
FIG. 5 is a diagram schematically illustrating the construction of the thermal head.

FIG. 5 is a diagram showing the construction of the thermal line head 154. The thermal line head has 2560 thermal elements 154H arranged in line. The thermal head 154 has two registers 154A and 154B. Print data for the first to 1280th elements is transferred to the register 154A as the DATA1, and print data for the 1281st to 2560th elements is transferred to the register 154B as DATA2. Each bit of the registers 154A and 154B corresponds to one of the thermal elements 154H. As mentioned above, the data DATA1 and DATA2 are transferred as serial data from the microprocessor 70 to the registers 154A and 154B synchronously using the transfer clock CLK.

The thermal elements 154H are divided into four groups, which are driven with the strobe signals /STB1 through /STB4, respectively. Each of the strobe signals /STB1 through /STB4 has a different phase. When each of the strobe signals /STB1–/STB4 is Low, the thermal elements 154H which correspond to data having a bit value of "1" are driven to radiate heat.

When 1280 bits of data are transmitted to the register 154A as the DATA1, /STB1 is set to Low for a predetermined period to start printing. When the /STB1 is changed from Low to High, /STB2 is set to Low, and printing according to the data stored in the register 154A is completed. When the /STB1 becomes Low, transfer of the DATA2 (the second group of 1280 bits of data) to the register 154B is initiated. When the /STB2 is changed from Low to High, since the DATA2 is already stored in the register 154B, the strobe /STB3 is changed from High to Low. Similarly, after the /STB3 is changed to High, the /STB4 is changed from High to Low, and the 2560 bits of data is printed, i.e., one line of a character image is printed.

As described above, in the printer 10, printing a character image in accordance with the DATA1 starts immediately after DATA1 is transferred to the register 154A. Further, DATA2 is transferred to the register 154B while the printing of data stored in DATA1 is performed. Thus, data stored in DATA2 can be printed immediately after DATA1 has been printed.

In this embodiment, the first time DATA1 is transferred to the register 154A, the data stored in the register 154B is ignored. Further, if one of the strobe signals is Low, even if the transfer clock CLK is transmitted to the thermal head, no data is written in the registers 154A and 154B. Thus, the data stored in the register 154A does not change when DATA2 is transferred to the register 154B.

During the printing of a character image in accordance with DATA2, DATA1 for the subsequent line is transferred to the register 154A, and the above printing process is repeated.

When the printing of one line has been completed, the voltage of the internal battery 64 is detected and checked before the next strobe signal /STB1 is changed to Low. If the voltage becomes lower than a predetermined value, the indicator 30 starts blinking. If the voltage of the internal battery 64 is lower than the minimum operable voltage, printing is terminated. Since current flows through the thermal elements 154H driven during printing, the voltage of the internal battery 64 is lowered in accordance with the number of thermal elements 154H driven.

In this embodiment, in order to lower power consumption, phase current available to the step motor 134 is lowered by changing /POWER_DOWN signal to Low when printing is not performed (i.e., when the sheet is not fed). In this embodiment, the regular phase current is 200 mA, and the phase current when the /POWER_DOWN signal is Low is 10 mA. Thus, prior to the printing operation, the phase current should be raised from 10 mA to 200 mA by changing the /POWER_DOWN signal from Low to High. In the present embodiment, the step motor 134 is driven using a two-phase exciting method. Therefore, total current applied to the motor 134 changes from 20 mA to 400 mA, which lowers the voltage of the battery 64. The microprocessor 70 then checks the voltage and if the voltage is lower than the minimum operative voltage, the microprocessor 70 controls the indicator 30 to blink, and stops the printing operation.

Figure 6:
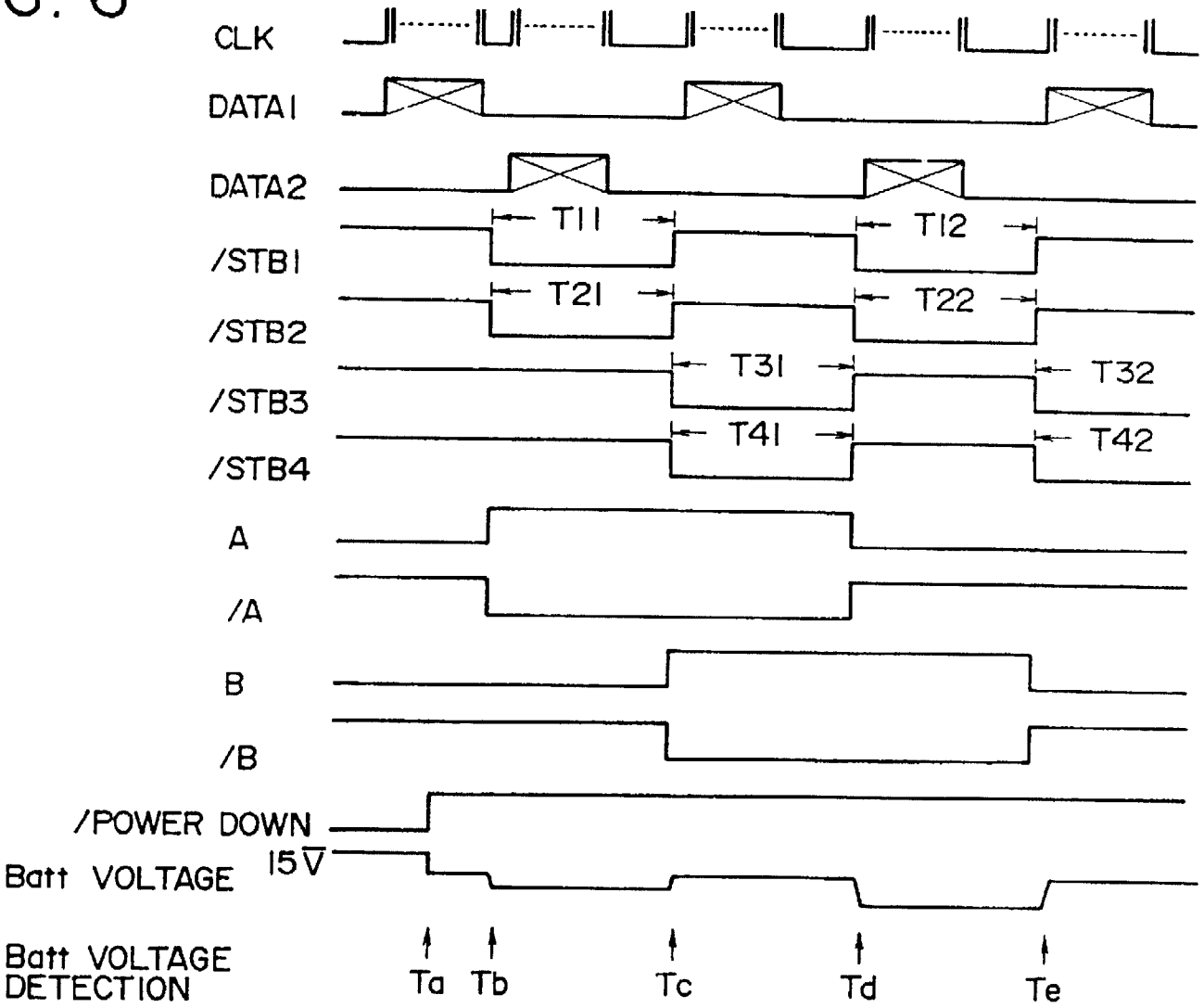
FIG. 6 is a timing chart showing the transmission of data, strobe pulses, and motor drive pulses.

A timing diagram of the printing operation is shown in FIG. 6. Before the printing operation, at Ta, the /POWER_DOWN signal is changed to High as described above. Then at Tb, motor driving pulse signals A, /A, B and /B are applied. In the embodiments, a two-phase exciting method is used for driving the pulse motor 34. After Tb, the pattern of the states of the pulse signals A, /A, B, and /B are subsequently changed, with two of the signals being High, while the other two signals are Low. Therefore, the current consumed when driving the motor 34 changes slightly during the printing operation. Thus, the voltage changes slightly as a result of driving the motor 134. However, depending on the number of thermal elements being driven, the voltage of the battery 64 will fluctuate while the printing operation is being executed during time interval Tb through Te, as shown in FIG. 6. The change of the voltage at Ta is due to the change of the /POWER_DOWN signal. The voltage of the battery is detected at Ta, and is also detected when the pattern of the motor driving pulses is changed at Tb, Tc, etc.

The operation of the first embodiment will now be described below.

As mentioned above, the thermal elements are divided into four blocks which can be driven independently. The four blocks of elements are arranged into two groups, with each pair of blocks in a group being driven simultaneously. Further, the two groups of blocks are driven at separate time intervals. The timing of the driving of the blocks is controlled by adjusting the timing of the strobe signals.

Each group includes 1280 thermal elements. If the blocks are arranged into predetermined groups, the situation may arise where one group has a large number of thermal elements being driven, while the other group has only a small number of thermal elements being driven. In this case, the former group may require more current than is available from the internal battery 64 in order to drive the large number of thermal elements. Thus, the image formed by this group would be lighter than the image formed by the latter group, resulting in a non-uniform image being printed. In view of this, it is preferable that the number of thermal elements to be simultaneously driven in each group be approximately the same.

Figures 7, 7A:
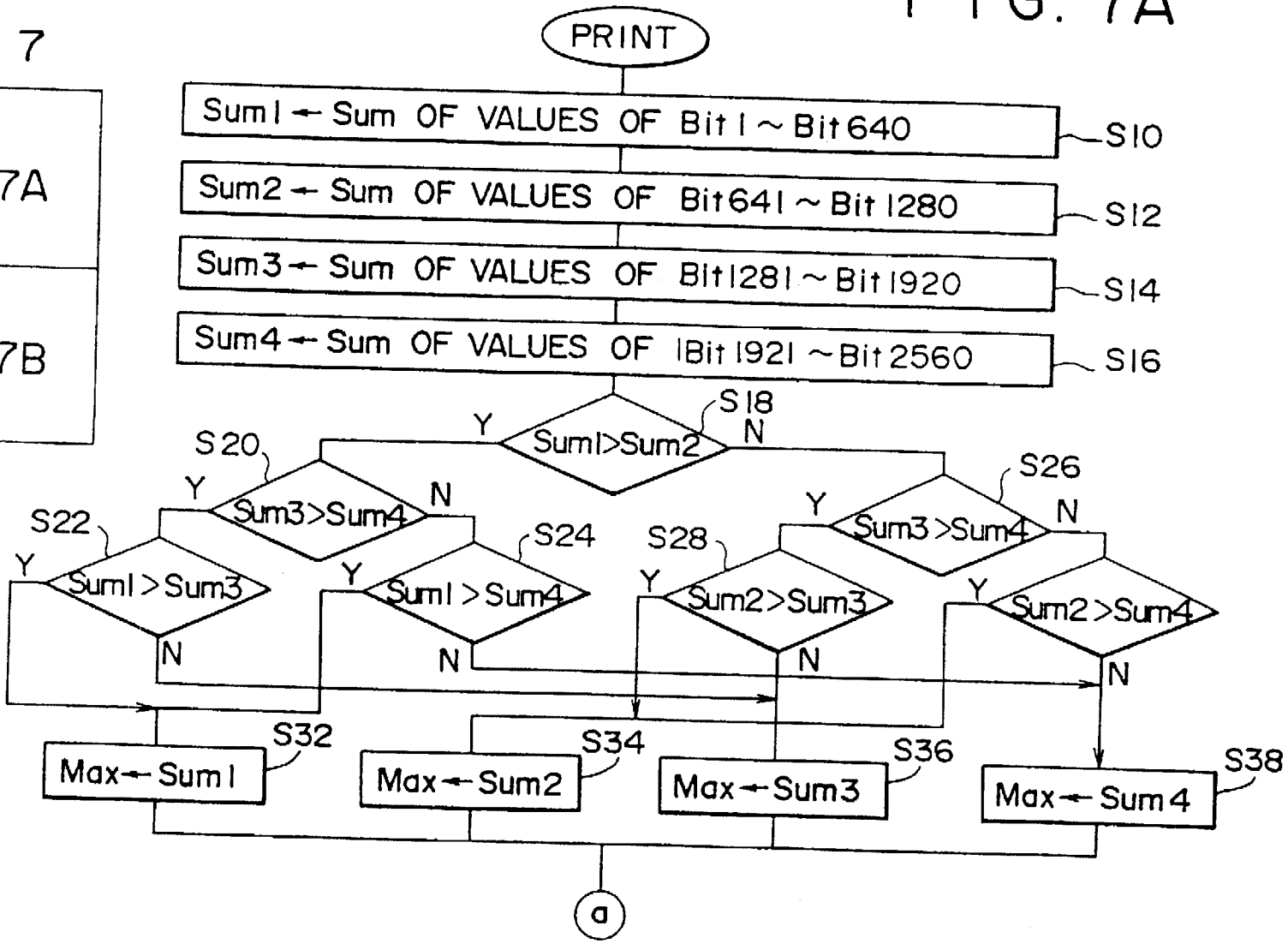
FIGS. 7, 7A and 7B are a flowchart illustrating a first embodiment of the invention.
Figure 7B:
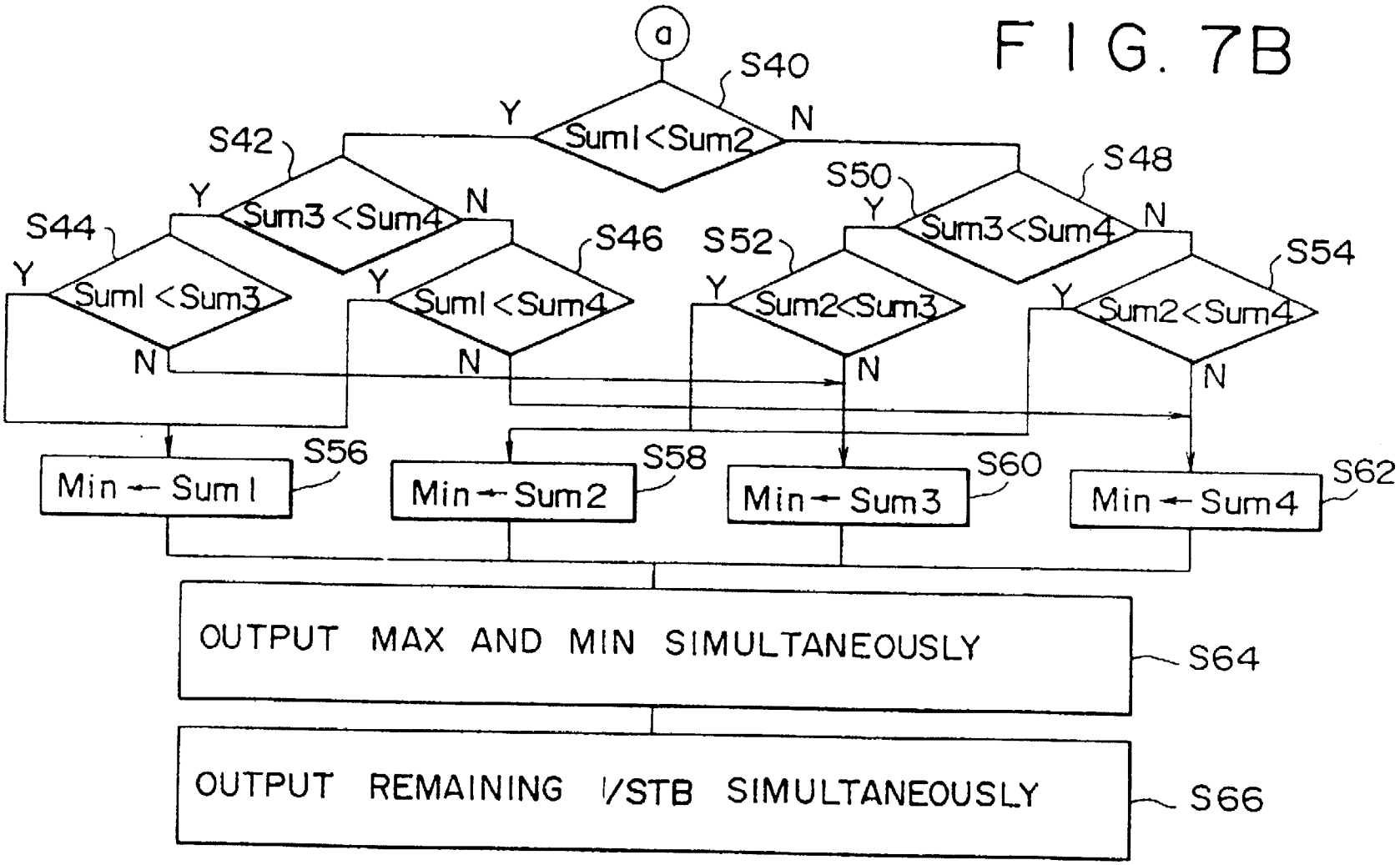

FIGS. 7A and 7B are a flowchart illustrating a control according to a first embodiment of the invention. In the first embodiment, a combination of four blocks of the thermal elements are determined according to the distribution of the data.

The data of DATA1 or DATA2 determines whether a thermal element is driven. More specifically, when the data bit is "1", the thermal element is driven, whereas when the data bit is "0", the thermal element is not driven. In Steps S10 through S16, the thermal elements are divided into four blocks, and the numbers Sum1, Sum2, Sum3 and Sum4 of the elements to be driven are detected by summing the number of thermal elements to be simultaneously driven for each of the four blocks. In Steps S18 through S38, the maximum sum of Sum1 through Sum4 is determined. Similarly, the minimum sum of Sum1 through Sum4 is determined in Steps S40 through S62. In Step S64, the strobe signals for the blocks having the maximum and the minimum numbers are outputted simultaneously. Then, the remaining two blocks are driven simultaneously in Step S66. With the above control, the number of thermal elements to be driven in the first group and the second group are more evenly balanced.

Figure 8:
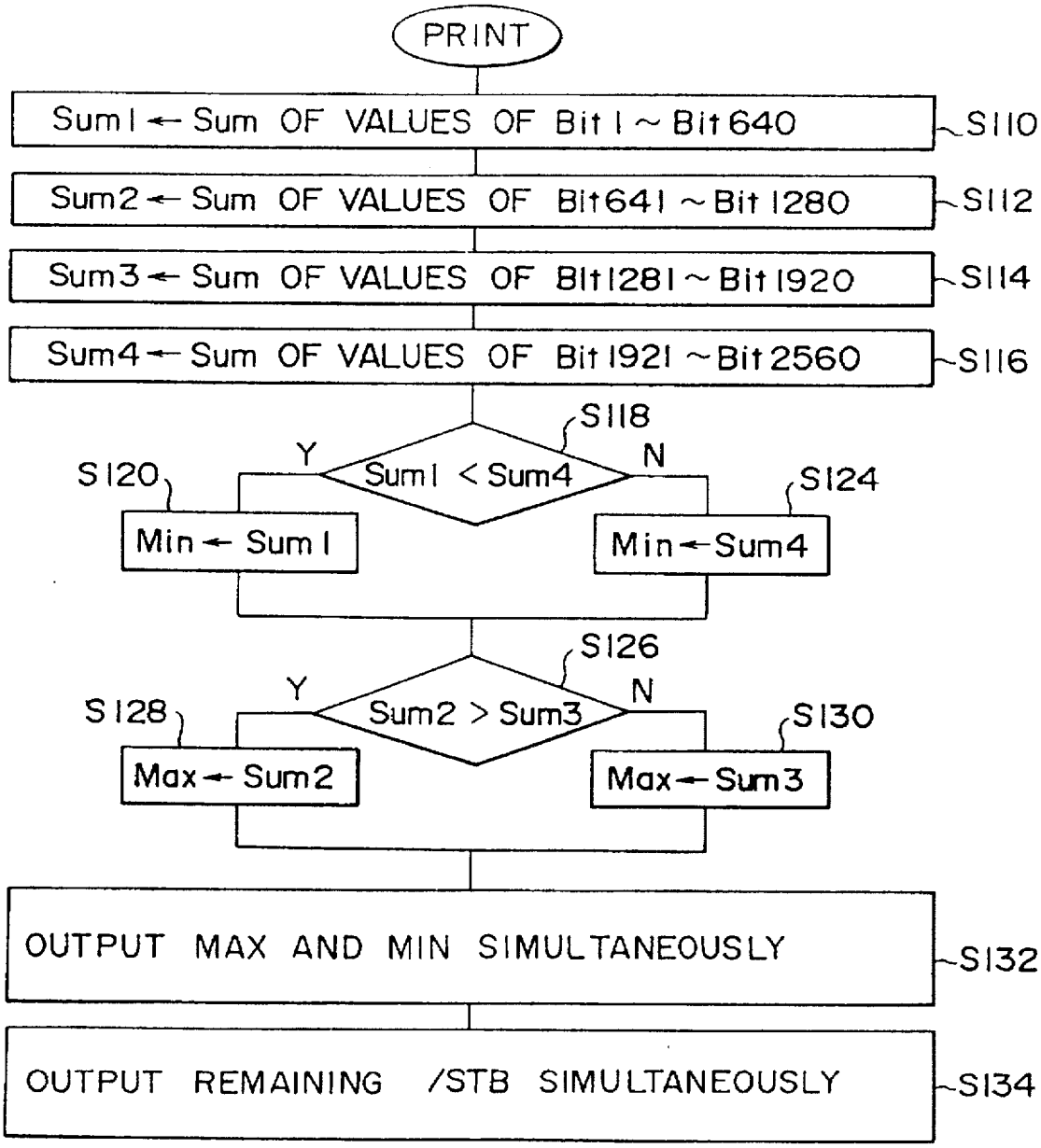
FIG. 8 is a flowchart illustrating a second embodiment of the invention.

FIG. 8 shows a second embodiment of the present invention which also balances the numbers of the thermal elements between two groups.

In Steps S110 through S116, the numbers Sum1 through Sum4 of thermal elements to be driven are determined for each block in a similar manner as described for the first embodiment. In this second embodiment, Sum1 is determined for the block located on the left part of the thermal print head, while Sum4 corresponds to the block on the right part of the thermal print head. Generally, each end of the print line has a margin break, and the number of the elements to be simultaneously driven is less than those in the central blocks. Thus, it is probable that Sum1 or Sum4 has a minimum value.

Conversely, in the central part of the thermal print head, a relatively large number of thermal elements are simultaneously driven. Thus, it is probable that Sum2 or Sum3 has a maximum value.

Therefore in the second embodiment, Sum1 and Sum4 are compared in Step S118 of FIG. 8 to determine which block has the minimum number, and a variable Min is set with the minimum of Sum1 or Sum4 in Steps S120 or S124, respectively. Further, Sum 2 and Sum 3 are compared in Step S126 to determine which block has the maximum number, and a variable Max is set with the maximum of Sum2 or Sum3 in Steps S128 or S130, respectively.

In Step S132, a block corresponding to the maximum value and a block corresponding to the minimum value are simultaneously driven as the first group by applying the appropriate strobe signals. Then in Step 134, the other remaining blocks are simultaneously driven as the second group. According to the second embodiment, the process for determining the groupings of the blocks can be done quickly.

As described above, according to the first and second embodiments, the battery can be used efficiently since the power to be consumed by the two groups of blocks are distributed as evenly as possible.

Figures 9, 9A:
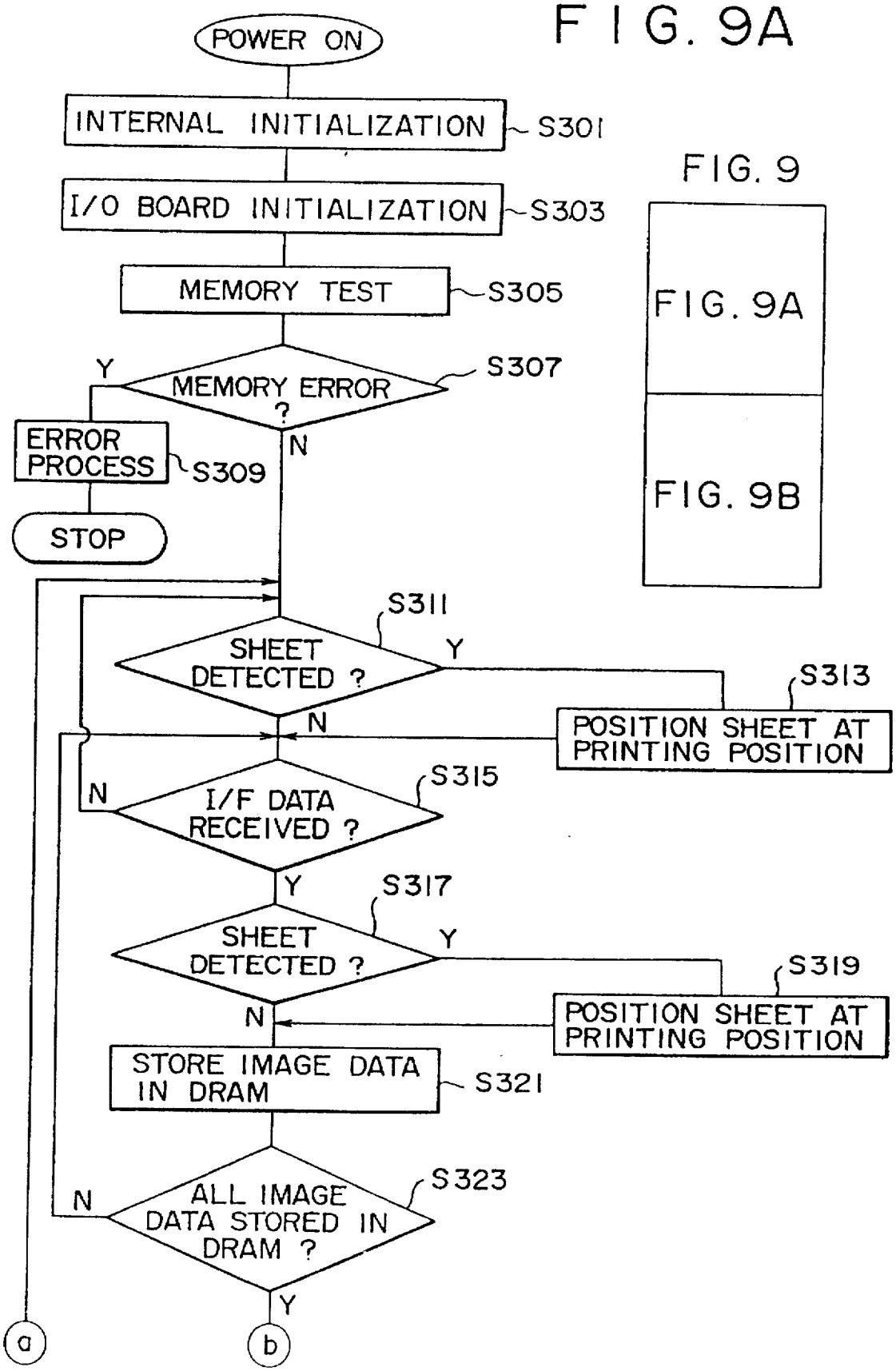
FIGS. 9, 9A and 9B are a flowchart illustrating a third embodiment of the invention.
Figure 9B:
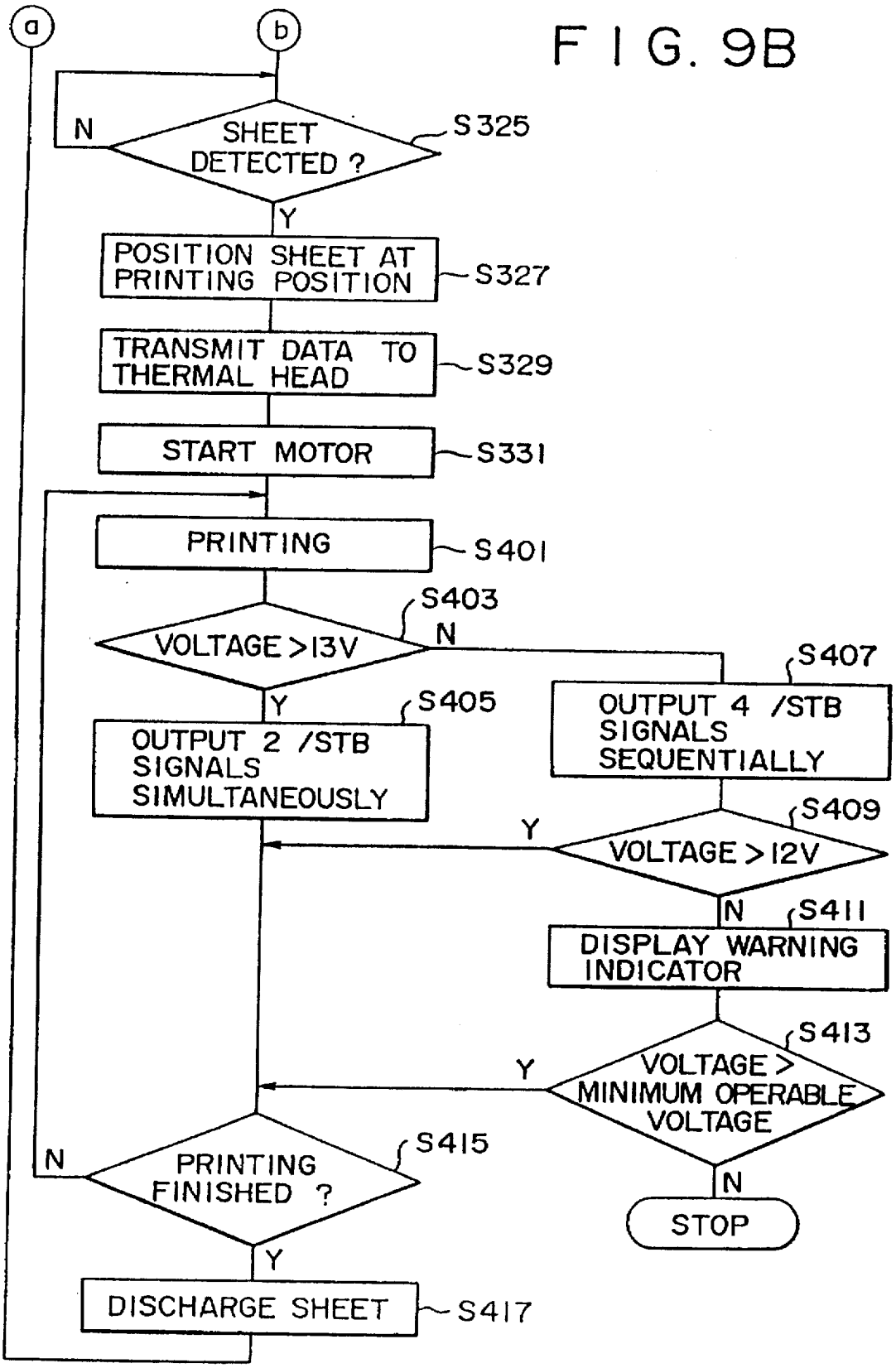

FIGS. 9A and 9B are a flowchart illustrating a control of a third embodiment according to the present invention.

The printer 10 uses a nickel-cadmium battery. The nickel-cadmium battery has a characteristic that its voltage is high when it is fully charged, and is lowered as power is consumed. Specifically, as the battery is discharged (loses energy) the voltage of the battery is slowly lowered until the energy stored in the battery reaches a predetermined level. If the battery is further discharged, the output voltage is lowered more abruptly.

If the number of the thermal elements is relatively large, and if the voltage of the battery is relatively low, sufficient current may not flow through each thermal element. In this case, the thermal elements may not generate sufficient energy to form an image on a thermosensitive sheet. Thus, in the third embodiment, the thermal elements are divided into a plurality of blocks, the number of blocks being determined in accordance with the voltage of the battery. Then, the blocks are driven at different time intervals.

As shown in FIG. 9A, the printer is turned ON, then initialization and memory tests are performed in Steps S301 through S305. If errors are detected in DRAM 74 in Step S307, the printing operation is not performed, the error is indicated in Step S309, and the operation is terminated.

If no errors are detected in Step S307, control goes to Step S311. If the sensor 206 or 208 detects the presence of a sheet P, the sheet P is positioned at a printing position (Step S313). Step S315 is then performed, and if data has not yet been received, Steps S311 and S315 are then repeated until data is received by the interface. In this embodiment, the sheet positioning process at Step S313 is executed for a first time when a sheet is detected, and will be skipped thereafter.

When data is received at the interface I/F (Step S315:YES), the presence of the sheet P is detected again in Step S317. If the sheet P is present, then sheet positioning is performed in Step S319 in a similar manner to that described for Step S313. Therefore, if the sheet has been positioned at the printing position, Step S319 is skipped.

The data received by the interface I/F is stored in the DRAM 74 in Step S321. The sequence of Steps S311 through S323 are repeated until the data corresponding to a page of the sheet P is stored in the DRAM 74. When all the data is stored in the DRAM 74 (Step S323:YES), the sheet P is detected in Step S325, and the positioning operation is executed in Step S327. This positioning operation is skipped if the sheet P has already been fed to the printing position in Steps S313 or S319. Since the data has been stored in the DRAM 74, the data is converted to bit map data in the bit map area in the DRAM 74.

In Step S329, the microprocessor 70 starts transmitting bit map data of the thermal head 154. When the data has been transmitted, the motor 134 is driven. If the voltage of the battery is greater than 13 V in Step S403, strobe signals /STB1 and /STB2 are outputted simultaneously. Similarly, for DATA2, the strobe signals /STB3 and /STB4 are outputted simultaneously in Step S405. Thus, the thermal elements are divided into four blocks, and each two block group is driven simultaneously.

Figure 10:
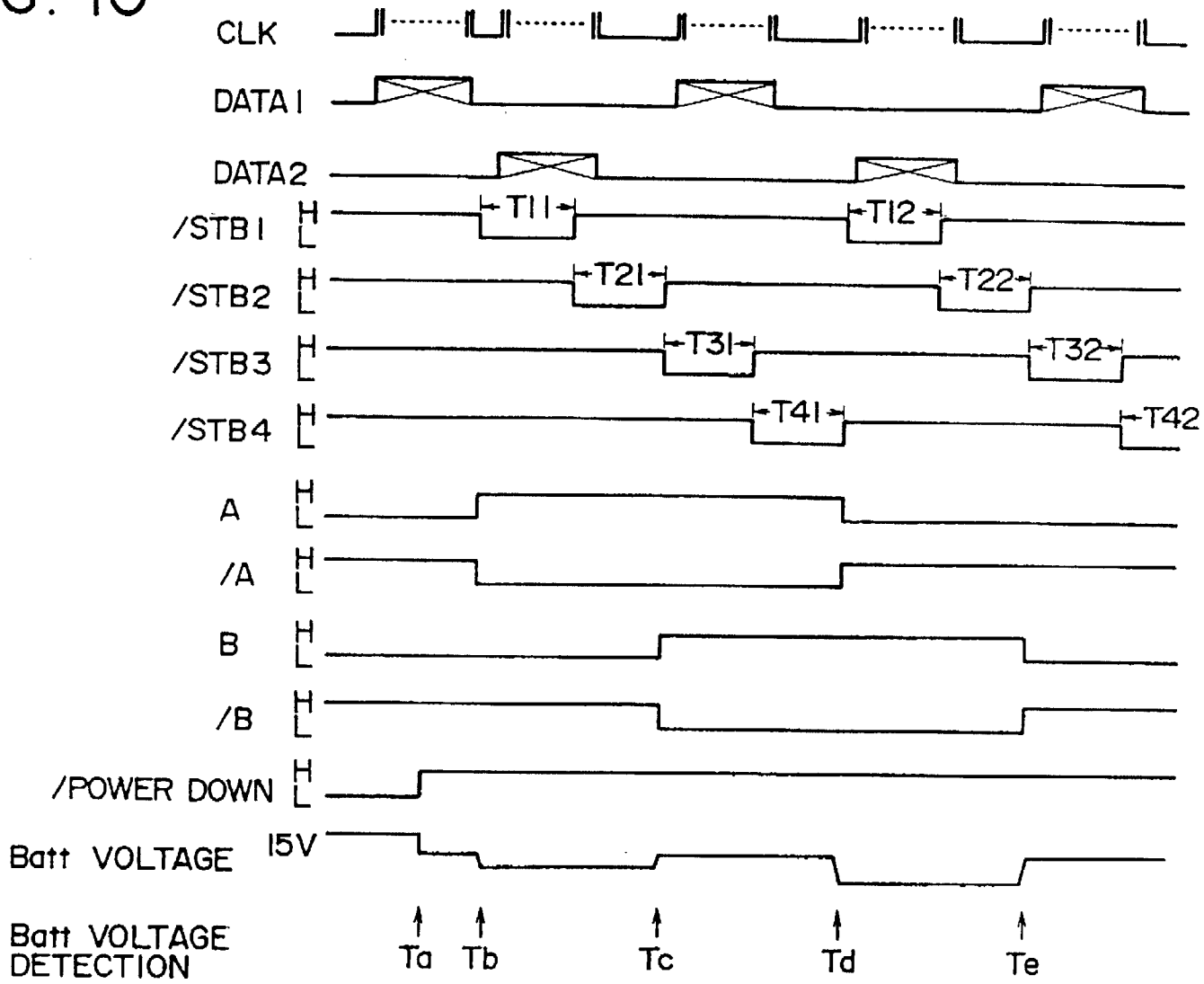
FIG. 10 is a timing chart illustrating the third embodiment of the invention.

If the voltage of the battery is 13 V or less, the strobe signals /STB1, /STB2, /STB3 and /STB4 are sequentially outputted (i.e., Low pulse is outputted) in Step S407, and also as shown in FIG. 10. If it is detected that the voltage of the battery is less than or equal to 12 V in Step S409, a warning indication is made in Step S411. Further, if the voltage of the battery is less than or equal to a minimum operable voltage in Step S413, then the printing operation is terminated. If the voltage of the battery is greater than the minimum operable voltage in Step S413, then the printing of the subsequent line is executed. When the printing operation is completed, the sheet P is discharged in Step S417, and the control goes to Step S311.

As described above, in the third embodiment, if the voltage of the battery is greater than 13 volts, the strobe signals /STB1 and /STB2 (or /STB3 and /STB4) are simultaneously outputted. In other words, 1280 thermal elements can be simultaneously driven as shown in FIG. 6. If the voltage becomes 13 V or less, only one strobe signal is outputted at a time as shown in FIG. 10. Thus, the number of the thermal elements simultaneously driven at a time is 640 or less. Therefore, each element can generate sufficient energy even if the voltage of the battery is low.

A fourth embodiment of the invention will be described below with reference to FIGS. 11, 12A and 12B.

Figure 11:
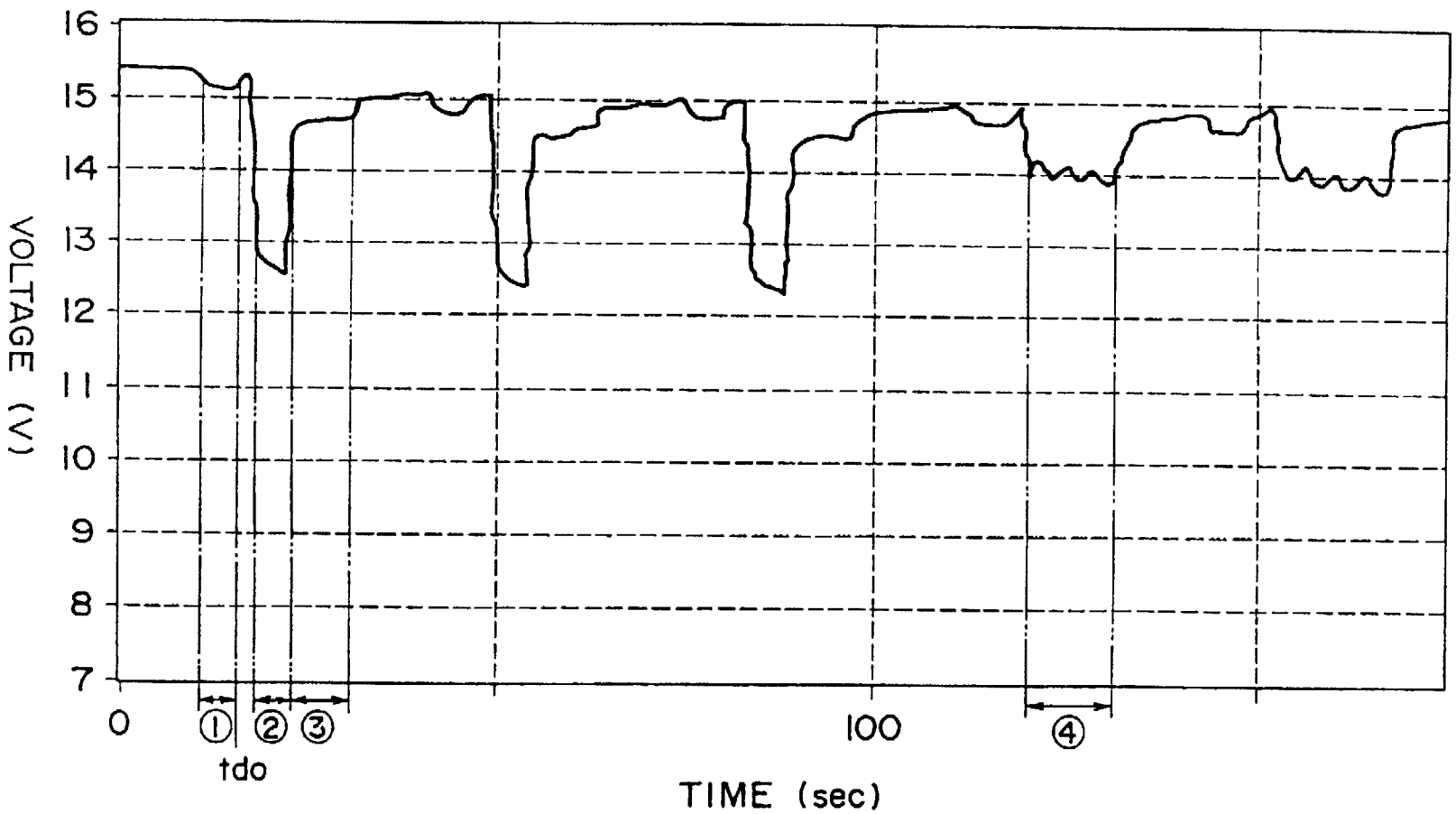
FIG. 11 is a graph showing the voltage of a battery.

FIG. 11 shows a voltage fluctuation of the nickel-cadmium battery 64. As mentioned above, the voltage of the nickel-cadmium battery 64 is reduced, as the battery 64 is discharged from its fully charged state, and further, the battery 64 has a characteristic that the output voltage changes depending on the load.

In FIG. 11, in period (1), the motor is driven to feed the sheet P to its printing position. During period (2), printing is performed with a printing ratio of 100% (i.e., all the thermal elements are simultaneously driven to generate heat), and therefore, in the period (2), the voltage is greatly reduced. Since printing and sheet feeding operations are simultaneously performed, the voltage is reduced as a result of consumption of power by both the motor and the thermal elements. In period (3), none of the thermal elements are driven (i.e., the printing ratio is 0%), and only the sheet P is fed by the motor. In period (4), a predetermined pattern of character strings are printed with a print ratio of 16%. The sum of the periods (2) and (3), or the period (4) corresponds to the length of one page of the sheet P.

If a large number of thermal elements are simultaneously driven, the temperature of the thermal head increases, while if the number of the simultaneously driven thermal head is relatively small, the temperature of the thermal head increases slightly. When the temperature of the thermal head is high, less extra heat is necessary in order to obtain a predetermined darkness of the image on the thermosensitive sheet P. In other words, if the thermal head is already heated, generation of a small amount of heat is required in order to produce an image having a sufficient darkness level. In the fourth embodiment, a line of a character image is formed taking the temperature fluctuation of the thermal head into consideration.

Specifically, as shown in FIG. 11, if the voltage of the battery is greatly reduced, it is assumed that a relatively large number of thermal elements are simultaneously driven, and that the temperature of the thermal head has been increased. More specifically, in the fourth embodiment, a period of time in which a thermal element is driven (i.e., a strobe pulse width) is determined as a function of a drop in a voltage level of the battery immediately after the previous line has been printed. The strobe pulse width is determined as a function of V1–V2, where V1 is a voltage when neither the motor nor the thermal elements are driven, and V2 is a voltage just after the preceding line has been printed. If the change in voltage (V1–V2) is small, then it is assumed that the temperature, of the thermal head increased slightly, and therefore, the strobe pulse width is elongated. Conversely, if the change of the voltage (V1–V2) is large, the temperature of the thermal head has been increased substantially, and the strobe pulse width is shortened.

Figures 12, 12A:
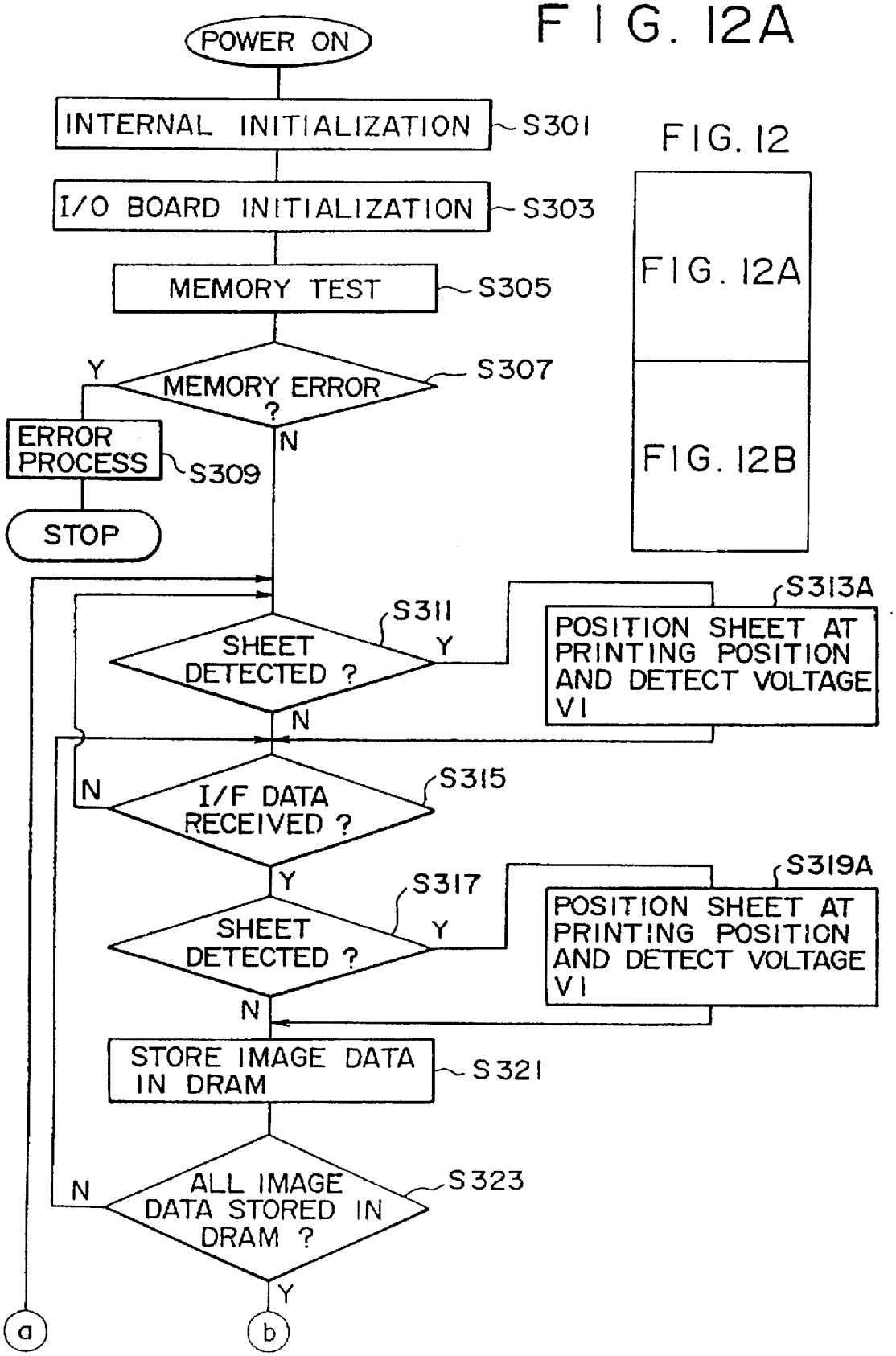
FIGS. 12, 12A and 12B are a flowchart illustrating a fourth embodiment of the invention.
Figure 12B:
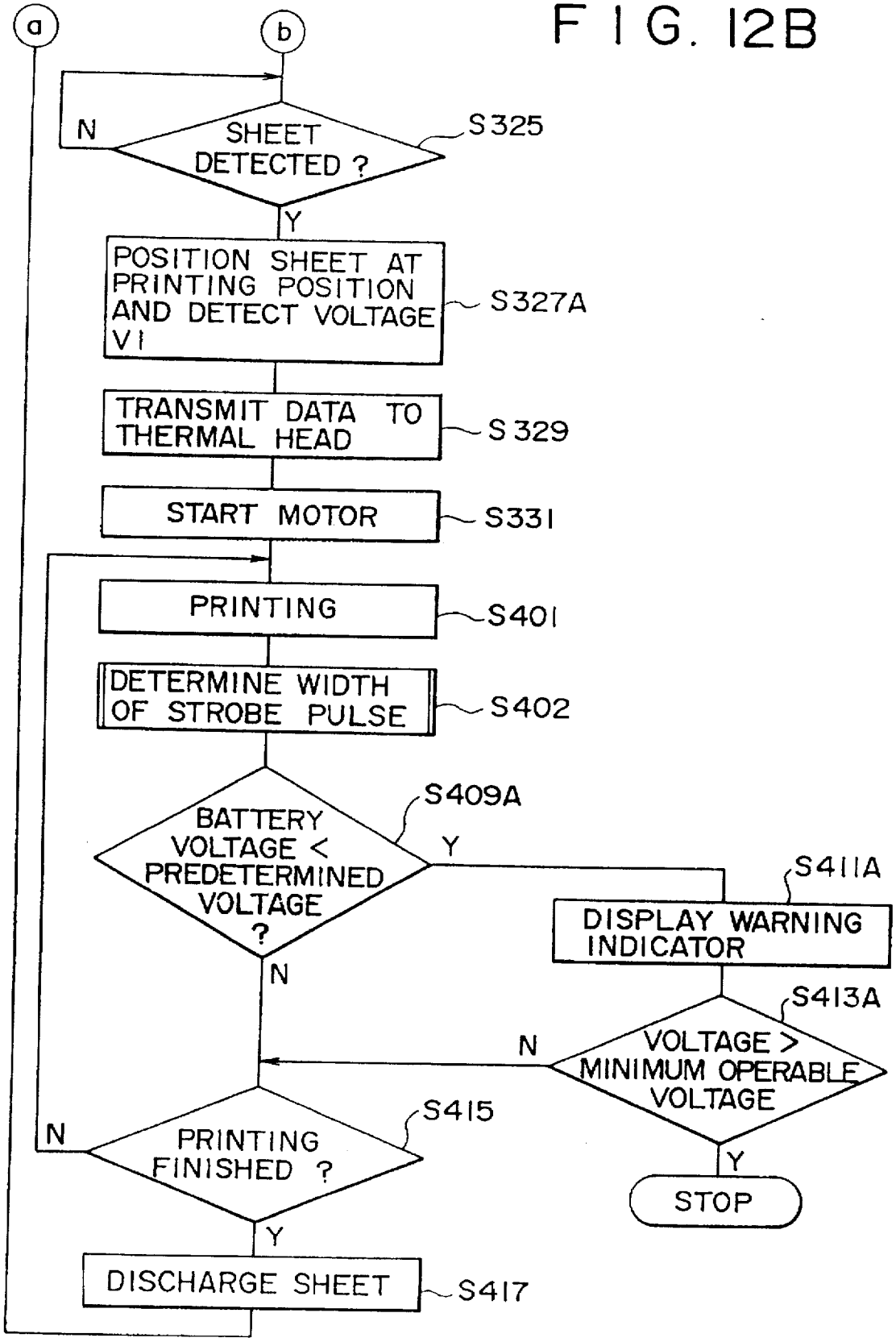

FIGS. 12A and 12B are a flowchart illustrating a control of the thermal printer according to the fourth embodiment.

The flowchart is similar to the flowchart shown in FIGS. 9A and 9B, with the Steps that are common to both operations having the same references. In the flowchart of FIGS. 12A and 12B, Steps S313A, S319A and S327A are similar to Steps S313, S319 and S327 shown in FIGS. 9A and 9B, except that the voltage V1 of the battery is detected when the sheet has been positioned at the printing position. After one line has been printed in Step S401, the width of the strobe pulse is determined in Step S402, and then the battery voltage is compared with a predetermined voltage value. If the battery voltage is less than the predetermined voltage value, then warning indicator 30 is displayed (blinks) in Step S411A. Then, in Step S413A it is determined whether the battery voltage is greater than a minimum operable voltage. If the battery voltage, is greater than the minimum operable voltage control goes to Step S415 where it is determined whether the printing is finished, as described for the flowchart shown in FIG. 9B. The control then goes to Step S417 where the paper is discharged.

Figure 13:
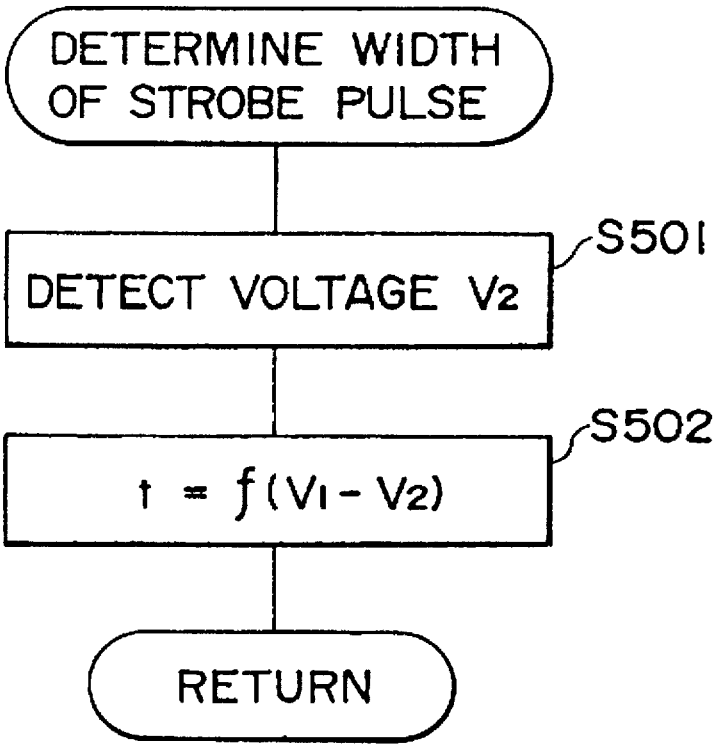
FIG. 13 is a flowchart illustrating a subroutine called in the flowchart shown in FIGS. 12A and 12B.

FIG. 13 is a subroutine, for determining the strobe pulse period as a function of the voltage fluctuation. In Step S501, the voltage V2 is detected immediately after the preceding line has been printed, and the strobe pulse width is determined in Step S502 as a function of the voltages V1 and V2. An example of the function can be expressed as:

$$t=T1+A/(V1-V2) \quad (1)$$

where, t is a strobe pulse width, T1 and A are constant values, V1 is a voltage of the battery when neither the motor nor the thermal elements are driven, and V2 is the voltage after the preceding line has just been printed.

As described above, according to the fourth embodiment, the energy generated by each thermal element is controlled by taking the temperature of the thermal head into consideration. This results in an image having a uniform level of darkness being formed on the thermosensitive sheet P regardless of the fluctuation of the printing ratio from one line to the next.

Figures 14, 14A:
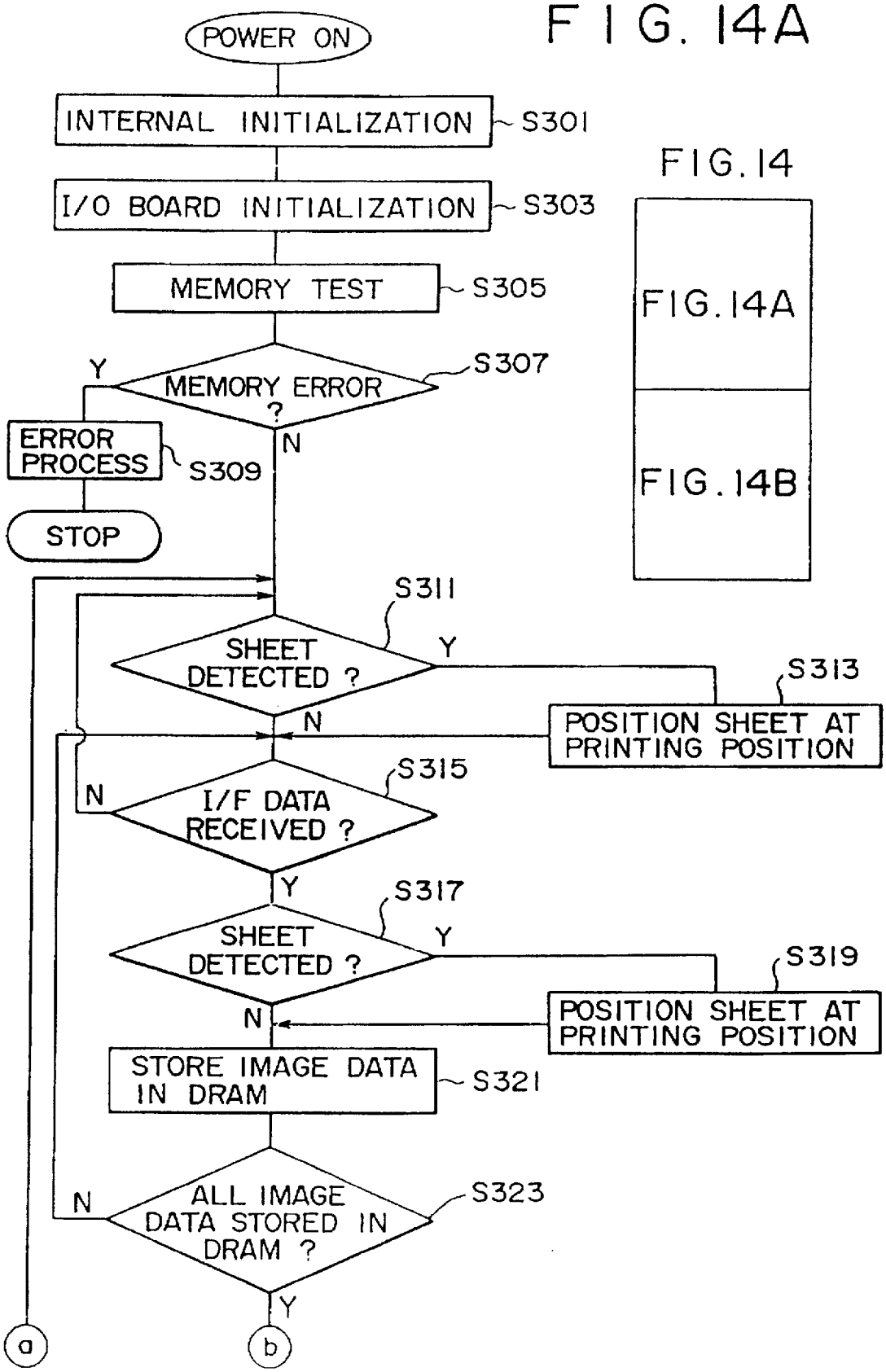

A fifth embodiment will be described with reference to FIGS. 14A and 14B.

If a relatively large number of thermal elements are simultaneously driven, each element may not generate sufficient heat since the available current is limited. In this case, the printed character image would be light. In the fifth embodiment, the strobe pulse width is determined in accordance with the number of the thermal elements that are simultaneously driven. The flowchart shown in FIGS. 14A and 14B is similar to the operation shown in FIGS. 9A and 9b, 12A and 12B, and therefore, steps having the same reference numbers will not be described below. The characteristic feature of the fifth embodiment as described above is shown in Steps S351 and S353 in FIG. 14B. Before the thermal elements are driven, the number of thermal elements to be simultaneously driven is determined in Step S351. In Step S353, based on the number of thermal elements to be simultaneously driven, a strobe pulse width is determined in accordance with the equation:

$$t=T+A*n/N \quad (2)$$

where, t is a period of time during which the thermal elements are simultaneously driven (i.e., the strobe pulse width), T and A are constants determined in accordance with the construction of the thermal head and the drive voltage, n is the number of thermal elements to be simultaneously driven, and N is the total number of thermal elements. The thermal elements are driven in accordance with the length of the strobe pulse width, and the printing operation is performed. Equation (2) is an example of a function, and an appropriate function can be determined for respective printers in order to determine the optimum strobe pulse width.

The present disclosure relates to subject matter contained in Japanese Patent Application Nos. HEI 5-294464, filed on Oct. 30, 1993, No. HEI 5-294465, filed on Oct. 30, 1993, No. HEI 5-305862, filed on Nov. 11, 1993, No. HEI 5-305863, filed on Nov. 11, 1993, which are expressly incorporated herein in their entireties.

What is claimed is:

1. A thermal printer having a thermal head provided with a plurality of linearly arranged thermal elements, said printer comprising:

a power source capable of supplying power of a predetermined power level to the plurality of thermal elements, the plurality of thermal elements being divided into a predetermined number of blocks, each of the blocks having a similar number of thermal elements;

a driver for driving the thermal elements with power supplied by the power source, in accordance with printing data, said thermal elements generating heat when driven by said driver; and a controller for dividing the plurality of thermal elements into at least two groups when the thermal elements are driven, said controller determining the at least two groups of thermal elements such that a difference in power consumption between the at least two groups is minimized, said controller determining the number of said thermal elements to be simultaneously driven in each of said blocks based upon said printing data, said controller combining said predetermined number of blocks to form said at least two groups such that a difference in said number of said thermal elements to be simultaneously driven in each group is minimized, said controller dividing said plurality of thermal elements into first, second, third and fourth linearly and sequentially arranged blocks, said controller determining which of said first and fourth blocks has a lesser number of thermal elements to be driven, and which of said second and third blocks has a greater number of thermal elements to be driven, said controller combining said block having said greater number of thermal elements to be driven and said block having said lesser number of thermal elements to be driven into one of said at least two groups;

said driver driving said groups at different time intervals.

2. The thermal printer according to claim 1, wherein the other one of said first and fourth blocks having a greater number of thermal elements to be driven and said other one of said second and third blocks having a lesser number of thermal elements are combined into another one of said at least two groups.

3. A thermal printer having a thermal head provided with a plurality of thermal elements that print data on a sheet, said thermal printer comprising:

a battery for supplying a predetermined voltage;

a driver for driving said plurality of thermal elements simultaneously by applying said predetermined voltage of the battery to said plurality of thermal elements; and a controller for determining a number of thermal elements to be driven in accordance with said printing data, and controlling said driver to vary a period of time during which said driver applies said predetermined voltage to said plurality of thermal elements in accordance with said number of thermal elements to be driven, said period of time being determined in accordance with the relationship:

$$t=T+A\cdot n/N$$

wherein t represents the period of time, T and A are constants, n represents the number of thermal elements to be driven, and N represents the number of the plurality of thermal elements.

4. A method of driving a plurality of thermal elements on a thermal head of a thermal printer, said thermal elements being linearly arranged, said method comprising:

dividing said plurality of thermal elements into a plurality of blocks, each of said plurality of blocks having a similar number of thermal elements;

determining a number of said thermal elements to be driven simultaneously in accordance with printing data;

combining said plurality of blocks into at least two groups such that a difference in a number of said thermal elements to be simultaneously driven in each group is minimized, said combining of said plurality of blocks into at least two groups comprising determining which block, of a pair of blocks located at linear ends of said plurality of blocks has a lesser number of thermal elements to be driven, and determining which block of a pair of blocks located between said pair of blocks located at linear ends of said plurality of blocks has a greater number of thermal elements to be driven, and combining said block determined to have said greater number of thermal elements to be driven simultaneously and said block determined to have said lesser number of thermal elements to be driven simultaneously into one of said groups; and driving said groups at different time intervals.

5. A thermal printer having a thermal head provided with a plurality of thermal elements that print data on a sheet, said thermal printer comprising:

a battery having an operating voltage which fluctuates depending on a load applied to said battery;

a driver for driving said plurality of thermal elements simultaneously in accordance with printing data, by applying said operating voltage of said battery;

a controller for evaluating power consumption when a previous line of an image was printed, and controlling said driver to vary a period of time during which said driver applies said operating voltage to said plurality of thermal elements for a current line, in accordance with said power consumption evaluated by said controller, said controller comprising a voltage detector for detecting a first voltage of said battery when printing has not been executed and a second voltage of said battery when printing has been executed.

6. The thermal printer according to claim 5, said period of time being determined as a function of said first and second voltages.

7. The thermal printer according to claim 6, wherein the function is:

$$t=T+A/(V1-V2)$$

where, t is the period of time, T is a constant value, A is another constant value, V1 is the first voltage, and V2 is said second voltage.

8. The thermal printer according to claim 5, wherein said period of time increases as the evaluated power consumption increases.

* * * * *

UNITED STATES PATENT AND TRADEMARK OFFICE

CERTIFICATE OF CORRECTION

PATENT NO. : 5,669,720

DATED : September 23, 1997

INVENTOR(S) : Kiyoshi Negishi et al.

It is certified that error appears in the above-identified patent and that said Letters Patent is hereby corrected as shown below:

At column 12, line 53 (claim 1, line 6) of the printed patent, change "the" to ---said---.

At column 12, line 55, (claim 1, line 8) of the printed patent, change "the" to ---said---.

At column 12, line 57 (claim 1, line 9) of the printed patent, change "the" to ---said---.

At column 12, line 58 (claim 1, line 10) of the printed patent, change "the" to ---said---.

At column 12, line 61 (claim 1, line 13) of the printed patent, change "the" to ---said---.

At column 12, line 62 (In claim 1, line 14) of the printed patent, change "the" to---said---.

UNITED STATES PATENT AND TRADEMARK OFFICE

CERTIFICATE OF CORRECTION

PATENT NO. : 5,669,720

DATED : September 23, 1997

INVENTOR(S) : Kiyoshi Negishi et al.

It is certified that error appears in the above-identified patent and that said Letters Patent is hereby corrected as shown below:

At column 12, line 63 (claim 1, line 15) of the printed patent, change "the" to ---said---.

At column 12, line 65 (claim 1, line 16) of the printed patent, change "the" to ---said---.

At column 13, line 31 (claim 3, line 7) of the printed patent, change "the" to ---said---.

At column 13, line 37 (claim 3, line 13) of the printed patent, change "said" to ---the---.

At column 13, line 45 (claim 3, line 19) of the printed patent, change "the" to ---said---.

Signed and Sealed this

First Day of September, 1998

Bruce Lehman

*Attest:*

BRUCE LEHMAN

*Attesting Officer*

*Commissioner of Patents and Trademarks*